US011767043B2

(12) United States Patent
Fang et al.

(10) Patent No.: US 11,767,043 B2
(45) Date of Patent: Sep. 26, 2023

(54) CONTROL METHOD FOR SUPPORTING DYNAMIC COUPLING AND UNCOUPLING OF TRAIN

(71) Applicant: CASCO SIGNAL CO., LTD., Shanghai (CN)

(72) Inventors: Xing Fang, Shanghai (CN); Ming Chang, Shanghai (CN); Xinjun Lu, Shanghai (CN)

(73) Assignee: CASCO SIGNAL CO., LTD., Shanghai (CN)

( * ) Notice: Subject to any disclaimer, the term of this patent is extended or adjusted under 35 U.S.C. 154(b) by 601 days.

(21) Appl. No.: 16/958,643

(22) PCT Filed: Oct. 31, 2018

(86) PCT No.: PCT/CN2018/112833
§ 371 (c)(1),
(2) Date: Jun. 26, 2020

(87) PCT Pub. No.: WO2019/128452
PCT Pub. Date: Jul. 4, 2019

(65) Prior Publication Data

US 2020/0369304 A1 Nov. 26, 2020

(30) Foreign Application Priority Data

Dec. 27, 2017 (CN) ..... 201711450032.1

(51) Int. Cl.
*B61L 27/04* (2006.01)
*B61G 7/00* (2006.01)
*B61L 15/00* (2006.01)

(52) U.S. Cl.
CPC ..... *B61L 27/04* (2013.01); *B61G 7/00* (2013.01); *B61L 15/0018* (2013.01); *B61L 15/0081* (2013.01); *B61L 2201/00* (2013.01)

(58) Field of Classification Search
CPC .. B61L 27/04; B61L 15/0018; B61L 15/0081; B61L 15/0072; B61L 15/0054; B61L 2201/00; B61G 7/00
See application file for complete search history.

(56) References Cited

U.S. PATENT DOCUMENTS 7,458,545 B1 * 12/2008 Ricks ..... A63H 19/24 701/19
8,942,868 B2 * 1/2015 Kanner ..... B61L 15/0054 701/19

(Continued)

FOREIGN PATENT DOCUMENTS

CN 102292252 A 12/2011
CN 203623659 U 6/2014

(Continued)

OTHER PUBLICATIONS

International Search Report (in English and Chinese) issued in PCT/CN2018/112833, dated Feb. 3, 2019.

*Primary Examiner* — Russell Frejd
(74) *Attorney, Agent, or Firm* — HAMRE, SCHUMANN, MUELLER & LARSON, P.C.

(57) ABSTRACT

A control method for supporting dynamic coupling and uncoupling of a train includes: step A, acquiring stored coupling status information during an initialization phase; step B, loading an off-line configuration of a corresponding composition according to the stored coupling status; step C, collecting three sets of input signals related to the coupling; step D, determining whether a train coupling status is proper according to the collected signals, then turning to step E if yes and turning to step F if no; step E, determining whether a current coupling status is consistent with the off-line configuration used in step B, then performing step H if yes and performing step G if no; step F, requesting emergency braking, and reporting an alarming error; step G, requesting (Continued)

emergency braking, re-writing coupling status information with codes after determining that the train is stationary, and then turning to step A for re-initialization.

10 Claims, 2 Drawing Sheets

(56) References Cited

U.S. PATENT DOCUMENTS

| | | | | |
|---|---|---|---|---|
| 2002/0105916 | A1* | 8/2002 | Smith | H04J 3/08 370/257 |
| 2002/0105978 | A1* | 8/2002 | Hines | H04J 3/14 370/465 |
| 2004/0133411 | A1* | 7/2004 | Babb | G06Q 30/02 703/22 |
| 2007/0146159 | A1* | 6/2007 | Kato | B61L 25/025 340/8.1 |
| 2008/0298384 | A1* | 12/2008 | Beaucage | H04L 25/0278 370/445 |
| 2010/0186619 | A1* | 7/2010 | Kumar | B60L 9/005 104/288 |

FOREIGN PATENT DOCUMENTS

| | | | |
|---|---|---|---|
| CN | 104477214 | A | 4/2015 |
| CN | 104787048 | A | 7/2015 |
| CN | 106476846 | A | 3/2017 |
| CN | 108163012 | A | 6/2018 |

* cited by examiner

CONTROL METHOD FOR SUPPORTING DYNAMIC COUPLING AND UNCOUPLING OF TRAIN

TECHNICAL FIELD

The disclosure relates to the field of signal control of urban rail transit, in particular, to a control method for supporting dynamic coupling and uncoupling of a train.

BACKGROUND

The passenger flow of urban rail transit lines is usually unevenly distributed in time, and there are obvious peaks of passenger flow during the commuting hours during workdays. In order to transport the stranded passengers in the station to the destination as soon as possible, more trains need to be invested during peak hours to improve operational capacity. However, in other time periods, the number of trains in operation is generally reduced to avoid waste of resources caused by empty trains. However, this mode of operation will cause passengers to wait too long during off-peak hours and reduce their satisfaction.

In addition, for lines connecting suburban new towns and city centers, the line will be designed as a "Y" branch to solve the problem of uneven distribution of passenger flow in the space, i.e., running separately in the suburban section and running in common in the city section. That is to say, the trains depart separately to the two end points leading to the branch, such as Lines 10 and 11 in Shanghai. In this case, the interval between trains on the branch road is also long. And, due to the limitation of the interval of trains running with the same lines, it is not possible to solve the problem of intervals being too long for the branch roads by increasing the number of running trains even during peak hours.

A method that can solve the uneven distribution of passenger flow in time and space, and can shorten the running interval of off-peak periods or branch roads adopts mixed operation with trains with different compositions. Specifically, a train with 8 or 6 long compositions during peak hours is used, but during off-peak hours, a train with long composition is uncoupled into a train with two 4 or 3 short compositions for running. In this way, the passenger load factor can be increased without excessively prolonging the waiting time of passengers and waste of resources caused by empty train running can be avoided while ensuring the operation intervals. For "Y"-shaped lines, a train with two short compositions can be coupled to be a train with long composition on the common line section for running, and uncoupled into a train with two short compositions at the branch station, respectively for heading to different destinations.

However, the reason why the above operating model cannot be implemented is that the existing train control system for urban rail transit does not support dynamic train coupling and uncoupling operations, that is, the composition of running trains must be fixed. And the reason is that in the on-board controller, parameter information such as the length of the train and the distance from the transponder antenna to the head of the train need to be stored in advance, which cannot be changed during the running. If there is a change on the composition of the train, the data of the on-board controller must be recorded to ensure that the information used in the controller is consistent with the actual train, otherwise the calculation for the train position will be wrong and serious safety problems will be caused.

Therefore, how to determine the train coupling status safely and reliably, and load and use configuration parameters that match the current train coupling status correctly and automatically is the key to achieve control on dynamic coupling and uncoupling of the train.

SUMMARY

An object of the disclosure is to provide a control method for supporting dynamic coupling and uncoupling of a train with high security, high reliability and high degree of automation so as to overcome the above shortcomings in the prior art. According to the method, an on-board signal system may automatically recognize a train coupling status and load a matching configuration for automatic driving and safety protection of the train. During the running, if the composition status of the train changes, the method will also ensure that the train stops safely, and then latest composition information is stored and used.

The purpose of the disclosure may realized by the following technical solutions.

A control method for supporting dynamic coupling and uncoupling of a train includes steps of:

step A, acquiring stored coupling status information during an initialization phase;

step B, loading an off-line configuration of a corresponding composition according to the stored coupling status;

step C, collecting three sets of input signals related to the coupling;

step D, determining whether a train coupling status is proper according to the collected signals, then turning to step E if yes and turning to step F if no;

step E, determining whether a current coupling status is consistent with the off-line configuration used in the step B, then performing step H if yes and performing step G if no;

step F, requesting emergency braking, and reporting an alarming error;

step G, requesting emergency braking, re-writing coupling status information with codes after determining that the train is stationary, and then turning to the step A for re-initialization;

step H, performing other functions of the signal system.

Preferably, the coupling status information stored in the step A is encoded; assuming that x indicates a non-encoded coupling status, and the encoding format used is as follows:

$$X_H = x$$

$$X_L = -r_{kx} + B_x$$

wherein $r_{kx}$ is a k-bit left shift operation of x; $B_x$ is a pre-assigned signature of a variable x; $X_H$ is an encoding high value of original information x; $X_L$ is an encoding low value of the original information x; $X_H$ and $X_L$ form encoded information of the original information x;

after the coupling information is read from a storage device, a verification is required for the correctness of the information with a verification algorithm as below:

$$\text{Bcheck}_x = r_{kx} + X_L - B_x$$

if $\text{Bcheck}_x$ is equal to 0, it means that the verification is successful; if $\text{Bcheck}_x$ 1 is not equal to 0, it means that the verification is failed, and the initialization fails and the program will exit.

Preferably, the off-line configuration in the step B includes an "uncoupling configuration", a "coupling configuration of driver's cab 1", and a "coupling configuration of driver's cab 2".

Preferably, the three sets of input signals in the step C are, respectively, "Train not coupled (ANS)", "Driver's cab 1 coupled (ACS1)", and "Driver's cab 2 coupled (ACS2)", for ensuring that true coupling statuses of the train are accurately reflected.

Preferably, the determining whether the train coupling status is proper according to the collected signals in the step D has a determination logic shown in a table as below, wherein combinations 2, 3, and 5 are proper, and the rest are improper:

| Combination | Three Collected Sets of Train Coupling Signals | | | |
|---|---|---|---|---|
| No. | ANS | ACS1 | ACS2 | Coupling Status |
| 1 | 0 | 0 | 0 | Improper |
| 2 | 0 | 0 | 1 | Driver's cab 2 Coupled |
| 3 | 0 | 1 | 0 | Driver's cab 1 Coupled |
| 4 | 0 | 1 | 1 | Improper |
| 5 | 1 | 0 | 0 | Not Coupled |
| 6 | 1 | 0 | 1 | Improper |
| 7 | 1 | 1 | 0 | Improper |
| 8 | 1 | 1 | 1 | Improper |

Preferably, the method supports defining four coupling statuses, and an on-board controller may store on-line coupling status information with security coding and pre-store three sets of off-line configurations while collecting three sets of hard-wired input signals from the train in real time and performing corresponding controls.

Preferably, the four coupling statuses include: Train not coupled, Driver's cab 1 of the train coupled, Driver's cab 2 of the train coupled, and an improper coupling status.

Preferably, for the storage of on-line coupling status information with security coding, the storage device supports on-line reading and writing; the stored coupling status information is security-encoded, and the verification is required for the correctness of the encoded information when the information is read to ensure the security of the system.

Preferably, for the storage of the three sets of off-line configurations, FLASH on a board is selected for a storage medium, and the off-line configuration includes information such as a corresponding train length, a distance from a transponder antenna to an end of the train, and a traction braking characteristic of the train under different composition statuses.

Preferably, the on-board signal system collects three sets of hard-wired signal inputs from the train in real time, including a signal indicating that the train is not coupled, a signal indicating that the driver's cab 1 is coupled, and a signal indicating that the driver's cab 2 is coupled.

Compared with the prior art, the present invention has the following advantages:

1) the disclosure enables mixed operation of a train with long compositions and a train with short compositions and on-line coupling and uncoupling, wherein manual recording of configurations is not required before and after the composition changes, which greatly improves the operation efficiency;

2) the on-board controller may determine the changes of the train coupling status in real time through the train input information to ensure that the train parameter configurations used are consistent with the actual coupling status and the positioning of the train may be always calculated correctly;

3) through expansion of the input of the coupling status from the train, many and more flexible formation modes may be supported.

DESCRIPTION OF EMBODIMENTS

The technical solutions in the embodiments of the present invention will be clearly and completely described hereafter in connection with the drawings in the embodiments of the present invention. It is apparent that the described embodiments are only a part of the embodiments of the present invention, but not the whole. Based on the embodiments of the present invention, all the other embodiments obtained by those of ordinary skill in the art without inventive effort are within the scope of the present invention.

Figure 1:
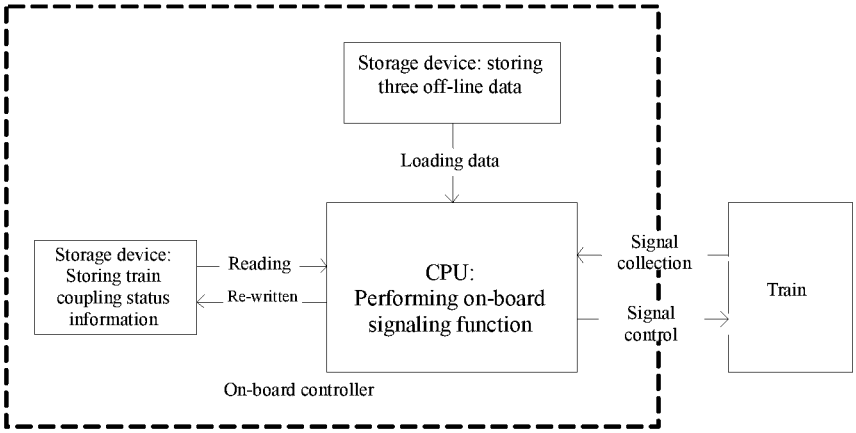
FIG. 1 is a view of the structure of the disclosure.

As shown in FIG. 1, a structure of an on-board controller supporting dynamic coupling and uncoupling of a train includes a storage device storing train coupling status information, a medium FLASH storing three on-line data, and a CPU performing on-board signaling functions.

Figure 2:
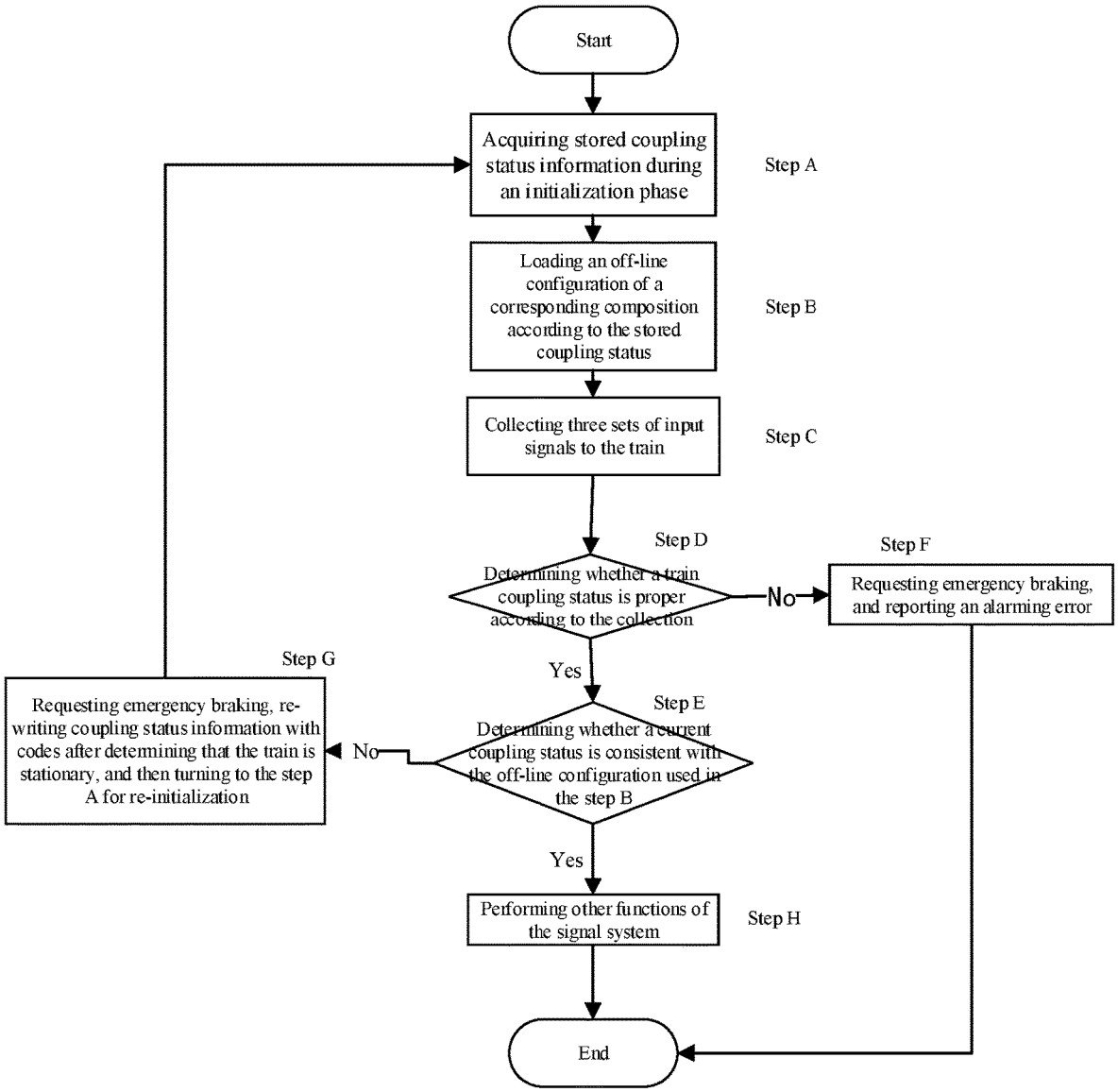
FIG. 2 is a flow chart showing operation of the disclosure.

As shown in FIG. 2, a flow chart showing operation of the disclosure is illustrated, which is specifically described as below:

step A, acquiring stored coupling status information during an initialization phase;

step B, loading an off-line configuration of a corresponding composition according to the stored coupling status;

step C, through interfacing with the train, collecting three sets of input signals related to the coupling;

step D, determining whether a train coupling status is proper according to the collected signals, then turning to step E if yes and turning to step F if no;

step E, determining whether a current coupling status is consistent with the off-line configuration used in the step B, then performing step H if yes and performing step G if no;

step F, requesting emergency braking, and reporting an alarming error;

step G, requesting emergency braking, re-writing coupling status information with codes after determining that the train is stationary, and then turning to the step A for re-initialization;

step H, performing other functions of the signal system.

The above steps further include the following characteristics:

For the step A, the coupling information stored in the step A is encoded; assuming that x indicates a non-encoded coupling status, and the encoding format used is as follows:

$$X_H = x$$

$$X_L = -r_{kx} + B_x$$

wherein $r_{kx}$ is a k-bit left shift operation of x; $B_x$ is a pre-assigned signature of a variable x. after the coupling information is read from a storage device, a verification is required for the correctness of the information with a verification algorithm as below:

$$\text{Bcheck}_x = r_{kx} + X_L - B_x$$

if $\text{Bcheck}_x$ is equal to 0, it means that the verification is successful; if $\text{Bcheck}_x$ 1 is not equal to 0, it means that the verification is failed, and the initialization fails and the program will exit.

For the step B, the possible off-line configuration in the train composition may have three kinds, including an "uncoupling configuration", a "coupling configuration of driver's cab 1", and a "coupling configuration of driver's cab 2".

For the step C, the three sets of input signals have to be provided separately by the train using different relays, and the three sets of inputs represent, respectively, "Train not coupled (ANS)", "Driver's cab 1 coupled (ACS1)", and "Driver's cab 2 coupled (ACS2)", for ensuring that true coupling statuses of the train are accurately reflected.

For the step D, the determining whether the train coupling status is proper according to the collected signals in the step D has a determination logic shown in a table as below:

| Combination | Three Collected Sets of Train Coupling Signals | | | |
|---|---|---|---|---|
| No. | ANS | ACS1 | ACS2 | Coupling Status |
| 1 | 0 | 0 | 0 | Improper |
| 2 | 0 | 0 | 1 | Driver's cab 2 Coupled |
| 3 | 0 | 1 | 0 | Driver's cab 1 Coupled |
| 4 | 0 | 1 | 1 | Improper |
| 5 | 1 | 0 | 0 | Not Coupled |
| 6 | 1 | 0 | 1 | Improper |
| 7 | 1 | 1 | 0 | Improper |
| 8 | 1 | 1 | 1 | Improper |

The disclosure has been successfully applied to the signal system provided by CASCO Signal Co., Ltd. for the LRT project in Addis Ababa, Ethiopia.

What is mentioned above is only the specific implementation of the present invention, but does not limit the protection scope of the present invention, and anyone skilled in the art may easily think of mortifications and alternations within the technical scope disclosed by the present invention, all of which should be contained within the protection scope of the present invention. Therefore, the scope of the present invention should be determined by the scope of the claims.

The invention claimed is:

1. A control method for supporting dynamic coupling and uncoupling of a train, comprising steps of:

step A, acquiring stored coupling status information during an initialization phase;

step B, loading an off-line configuration of a corresponding composition according to the stored coupling status;

step C, collecting three sets of input signals related to the coupling;

step D, determining whether a train coupling status is proper according to the collected signals, then turning to step E if yes and turning to step F if no;

step E, determining whether a current coupling status is consistent with the off-line configuration used in the step B, then performing step H if yes and performing step G if no;

step F, requesting emergency braking, and reporting an alarming error;

step G, requesting emergency braking, re-writing coupling status information with codes after determining that the train is stationary, and then turning to the step A for re-initialization;

step H, performing other functions of the signal system.

2. The method according to claim 1, wherein the coupling status information stored in the step A is encoded; assuming that x indicates a non-encoded coupling status, and the encoding format used is as follows:

$$X_H=x$$

$$X_L=-r_{kx}+B_x$$

wherein $r_{kx}$ is a k-bit left shift operation of x; $B_x$ is a pre-assigned signature of a variable of x; $X_H$ is an encoding high value of original information x; $X_L$ is an encoding low value of the original information x; $X_H$ and $X_L$ form encoded information of the original information x;

after the coupling information is read from a storage device, a verification is required for the correctness of the information with a verification algorithm as below:

$$\text{Bcheck}_x=r_{kx}+X_L-B_x$$

if $\text{Bcheck}_x$ is equal to 0, it means that the verification is successful; if $\text{Bcheck}_x$ 1 is not equal to 0, it means that the verification is failed, and the initialization fails and the program will exit.

3. The method according to claim 1, wherein the off-line configuration in the step B comprises an "uncoupling configuration", a "coupling configuration of driver's cab 1", and a "coupling configuration of driver's cab 2".

4. The method according to claim 1, wherein the three sets of input signals in the step C are "Train not coupled (ANS)", "Driver's cab 1 coupled (ACS1)", and "Driver's cab 2 coupled (ACS2)", for ensuring that true coupling statuses of the train are accurately reflected.

5. The method according to claim 1, wherein the determining whether the train coupling status is proper according to the collected signals in the step D has a determination logic shown in a table as below, wherein combinations 2, 3, and 5 are proper, and the rest are improper:

| Combination | Three Collected Sets of Train Coupling Signals | | | |
|---|---|---|---|---|
| No. | ANS | ACS1 | ACS2 | Coupling Status |
| 1 | 0 | 0 | 0 | Improper |
| 2 | 0 | 0 | 1 | Driver's cab 2 Coupled |
| 3 | 0 | 1 | 0 | Driver's cab 1 Coupled |
| 4 | 0 | 1 | 1 | Improper |
| 5 | 1 | 0 | 0 | Not Coupled |
| 6 | 1 | 0 | 1 | Improper |
| 7 | 1 | 1 | 0 | Improper |
| 8 | 1 | 1 | 1 | Improper. |

6. The method according to claim 1, wherein the method supports defining four coupling statuses, and an on-board controller may store on-line coupling status information with security coding and pre-store three sets of off-line configurations while collecting three sets of hard-wired input signals from the train in real time and performing corresponding controls.

7. The method according to claim 6, wherein the four coupling statuses comprise: Train not coupled, Driver's cab 1 of the train coupled, Driver's cab 2 coupled, and an improper coupling.

8. The method according to claim 6, wherein for the storage of on-line coupling status information with security coding, the storage device supports on-line reading and writing; the stored coupling status information is security-encoded, and the verification is required for the correctness of the encoded information when the information is read to ensure the security of the system.

9. The method according to claim 6, wherein for the storage of the three sets of off-line configurations, FLASH on a board is selected for a storage medium, and the off-line configuration comprises information such as a corresponding train length, a distance from a transponder antenna to an end of the train, and a traction braking characteristic of the train under different composition statuses.

10. The method according to claim 6, wherein the on-board signal system collects three sets of hard-wired signal inputs from the train in real time, comprising a signal indicating that the train is not coupled, a signal indicating that the driver's cab 1 is coupled, and a signal indicating that the driver's cab 2 is coupled.

* * * * *